United States Patent [19]

Messmer et al.

[11] 4,069,522

[45] Jan. 24, 1978

[54] BABY COMMODE

[75] Inventors: Heinz Messmer, Aurich; Martin Schwab, Effretikon, both of Germany

[73] Assignee: Heimess Heinz Messmer - Haus Baby-Gluck, Aurich, Germany

[21] Appl. No.: 680,792

[22] Filed: Apr. 27, 1976

[30] Foreign Application Priority Data

| | | |
|---|---|---|
| Oct. 10, 1975 | Germany | 2545375 |
| May 2, 1975 | Switzerland | 005666/75 |

[51] Int. Cl.[2] ..... A47K 11/06; A47K 11/02

[52] U.S. Cl. ..... 4/138; 4/141

[58] Field of Search ..... 4/138, 141, 142, 112, 4/113, 135, 136, 111

[56] References Cited

U.S. PATENT DOCUMENTS

| | | | |
|---|---|---|---|
| 2,602,166 | 7/1952 | Aitken | 4/141 |
| 2,662,229 | 12/1953 | Wenkstern | 4/135 |
| 3,077,608 | 2/1963 | Renje | 4/142 |
| 3,401,408 | 9/1968 | Buck | 4/141 |

*Primary Examiner*—Henry K. Artis

[57] ABSTRACT

A commode for a child being a body formed by a central wall defining a pot and an outer wall spaced therefrom and including a repository attached or enclosed therein for toilet accessories.

17 Claims, 7 Drawing Figures

BABY COMMODE

BACKGROUND OF THE INVENTION

The present invention relates to a baby commode, such as a chamberpot, toilet training stool, infant night pot, a child's seat, a seat for a W C-pan, a travel bedpan or the like, and also to combinations of the same.

A multitude of child's commodes are known in various forms which vary according to the age of the child for whom it is intended and to the various places of intended use. All these commodes have the one disadvantage that, after use by the child, the accessories needed for the cleanup and skin care, e.g. the toilet paper, soap, lotion, powder etc., are not readily available for use, and have to be searched out in the bathroom or at another place.

Another drawback exists in structuring the seat to avoid urine spillage and to promote proper seating of the child during the performance of the necessary body function. Also, it is a drawback of many prior seats of this type that they do not sit squarely on the ground and are easily movable by the child sitting thereon.

SUMMARY OF THE INVENTION

It is an object of the present invention to provide a child's commode which substantially simplifies the cleanup and skin care of the child.

This object is obtained according to the invention by providing contiguously or integrally with the commode, a package, or roll of tissues, a fragrance dispenser, and or any other accessories needed for the care of the child. Thus all articles needed for the cleaning and care of the baby are ready for use as soon as the commode has been used. In that way the mother saves many steps to the bathroom, toilet or any other place where the accessories are stored, and the commode may be thus truly portable.

In the simplest case the commode itself is provided with a repository or pocket for these accessories. Another version provides an injection molded part unto which a pocket is integrally molded. A construction may be preferred where a pot-shaped central portion, formed by an inner supporting wall is provided with a rim which extends into an outer supporting wall spaced therefrom, leading downwardly to form a base edge. The pocket is arranged between the central wall and the outer wall and is open from the top down. Preferably, the pocket is located in the portion forming the back wall or backrest for the child. A closure flap or door means may also be provided so that the child is prevented from seizing the accessories.

The pocket may be also built in such a way, that it is constructed as a separate plastic injection molding, which may be secured to the inner wall and/or outer wall, and which extends downwardly to the base edge. The pocket may be in the form of a drawer capable of being pushed into the cavity or space between the outer wall and the central wall through an opening in the outer rim or transitional edge between the walls. Access is made impossible for the child by arresting the drawer in its closed position. A covered and thereby secure disposition of the prepared accessories may be obtained by forming the pocket as an injection molded plastic part which is provided with holding means insertable in the pocket, and which holds the accessories. The insertable holding means is formed in conformity with the nature and shape of the accessories in which case they may be furnished in separate packages. For example, the insertion means may be formed like a bearing axle or shaft for a roll of tissues or in the form of a package dispenser holder. The taking out of tissues may be facilitated by providing an opening in the area of the backrest of the commode having a transverse slot which guides the tissues outwardly to the rear. This opening may also be formed to provide a grip aiding in handling of the commode.

In another version tissues, fragrance dispenser, skin care means and other accessories may be supplied in the form of a package fastened directly unto the commode by the aid of fastening means. For this purpose well known fastening means are useful like hooks, clamps, magnets, pressure sensitive films. The fastening means may be parts of the package, may be capable of being pushed into conforming openings in the wall of the commode, or capable of being fastened therein. The container for the prepared accessories may, in another version, be provided with additional means for fastening unto the outer wall of the commode.

Various possibilities for the embodiment of an additional receptacle or pocket exist for the storage of accessories. They may be built conforming to the kind of accessory and/or the manner of their dispensing or use. Various articles of commerce may be used instead of the tissues, in which case a soft, absorbent paper is preferred which may also be antiseptic, germfree and enriched with scents.

Slits for the fastening of a safety belt are provided in the area of the backrest of the commode so that the child may be strapped into position while using the commode. The transition from the inner wall to the outer wall is built as an anatomic seating ring, so that the child may sit comfortably thereon.

Another embodiment provides a heightening or upward enlargement of the seating ring in the frontal area so as to form a deflector useful primarily for boys to prevent spillage of urine.

The front wall of the commode may be formed so as to be provided with holes or recesses allowing for the fastening of holding means thereto, to which a grip handle, or similar carrying arm in the shape of a toy or other object can be secured.

The commode is preferably provided with suction means located beneath the central pot part which is adapted to engage the ground or floor, enabling the solid positioning of the commode upon a separate base, so that the child may not move it along the floor. Such suction means may be controlled to be locked or unlocked by aid of an adjustable lever, accessible through an opening in the side of the outer wall. The suction means preferably comprises a movable rubber plate, a positioning rim which embraces said rubber plate and the adjustable lever.

A deodorant tablet or dispenser may be fastened or arranged adjacent the cavity of the commode, preferably by an adhesive. Additional holes are provided in the area of the fastening means allowing contact of the air with the deodorant.

In accordance with the present invention, arbitrary implements may be added, without any difficulties and without minimizing the usefulness of the pot shape, and without deviating from the general use of inner and outer spaced walls having a comfortable seating ring.

This is obtained by providing the front portion of the outer supporting wall with an opening or recess adjacent the lower edge and opening in the direction of the base which recess is capable of receiving and accepting a U-shaped spring clamp serving as a carrier for additional implements. This small recess in the outer supporting wall does not impair the basic shape of the inner pot or the seating rim, and the additional carrier bracket with its handle implements may be added unto the commode without tools or any further refinishing operations. The spring like action of the clamp fastens simultaneously the carrier unto the supporting wall of the commode.

Preferably, the recess and the carrier are built in such a way that the width of the recess conforms to the width of the clamp, which is made from flat band material, and that the height of the recess conforms to the thickness of the flat band material. In other words the distance between the two legs of the U-shaped clamp approximates the thickness of the positioning wall, so that the band fits in the recess snugly and conforms to the base edge of the outer supporting wall.

A sufficient spring length of the clamp is obtained by approximating the height of the positioning wall in the area of the recess when forming the free length of the leg of the clamp. Various additional implements may be fastened solidly or interchangeably to the carrier with the clamplike fastening end.

Additional objects and features of the invention will appear from the following embodiments which are described in the accompanying drawings.

DESCRIPTION OF THE INVENTION

Figure 1:
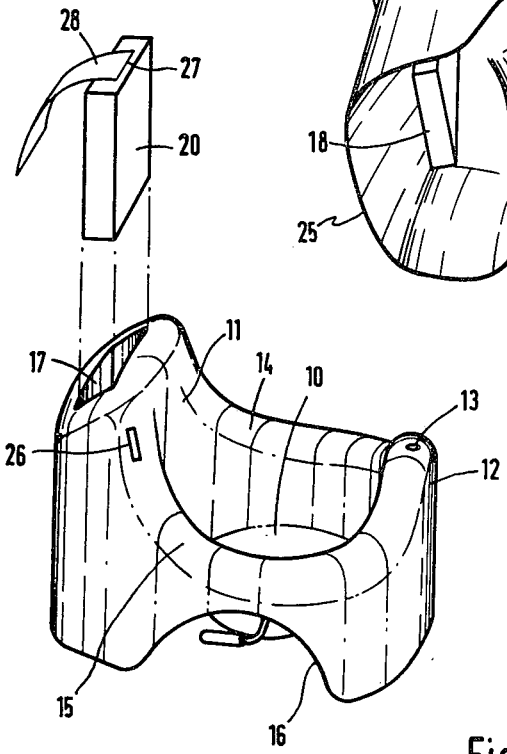
FIG. 1 is a perspective side elevation of a child's commode or chamberpot.
Figure 2:
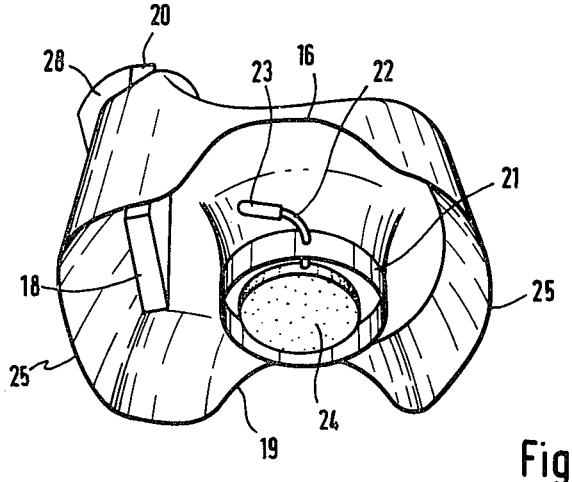
FIG. 2 shows the commode according to FIG. 1 in a perspective view from the bottom.

The child's commode or chamberpot as seen in FIGS. 1 and 2 is manufactured as a one-piece injection molded body having a central pot formed by an inner wall 10 and a conforming circumferential outer wall 25 spaced therefrom. The outer wall forms a depending skirt and is shaped at its lower edge to seat firmly on a floor, table, commode or similar support surface. The inner and outer walls are connected by rounded transition edges 11, 12, 14 and 15 forming a continuous ring on which a child may easily sit. The edge 11 is formed to extend upwardly to form a backrest for the child. Behind the backrest the outer wall is enlarged to provide increased stability. The edges 14 and 15 of said seating ring conform to the shape of a child's buttocks and guarantee an anatomically advantageous seat. The front side of the transition edge 12 is formed upwards to provide a deflector suitable preferably, for male children. A hole 13 is provided in the upper apex of the deflector 12 unto which manual holding means, such as a handle, may be affixed. These holding means may be formed as holding grips or may also be shaped like toys as hereinafter explained.

The outer wall 25 of the commode is, as seen in FIG. 2, provided with recesses 16 and 19 along the respective sides, which serve as grips allowing for the insertion of a hand, whereby the commode may be carried. The recesses allow access to suction means permitting the commode to be detachably fastened to the ground, upon a floor or upon a separate standing support. The suction means are mounted at the base of the central wall 10 and comprise a positioning rim 21, in which an adjusting lever 22 having an actuating handle 23 is pivotally mounted. Over this adjusting lever 22 is mounted a deformable rubber plate 24, the periphery of which is surrounded by the positioning rim 21 so that the rubber plate 24 forms a cavity towards the base, and is solidly sucked unto the base by the suction created when the rubber plate is deformed. The actuating end 23 of the adjusting lever 22 is accessible through the lateral recess 16 of the outer wall 25.

The backrest 11 is provided with slits 26, into which a safety strap for holding the child may be inserted or secured. The strap preferably passes through the slits behind the wall forming the backrest 11. Furthermore, a pocket 18 is formed in the backrest 11 and is provided with an opening 17 extending from the top downwardly. The pocket is formed in the wall forming the backrest 11 and is integral therewith providing a receptacle for toilet articles, e.g. a package 20 of tissues may be inserted and stored in the pocket 18. The package 20 is preferably provided on its upper side with a prescored opening 27 through which the tissues 28 may be pulled out, without removal of the package from the pocket 18.

The tissues 28 may be enclosed singly or multiple folded in its package in a known manner. Such tissues 28 are adapted for this particular use and are therefore soft and endowed with high absorption ability. Furthermore, they may be antiseptic, impregnated with a germicide and enriched with fragrant materials. Other toilet articles may be also introduced into this pocket 28, which if desired, may be closed with a cover having a spring so that the child is prevented from directly grabbing any of the provided objects.

Figure 3:
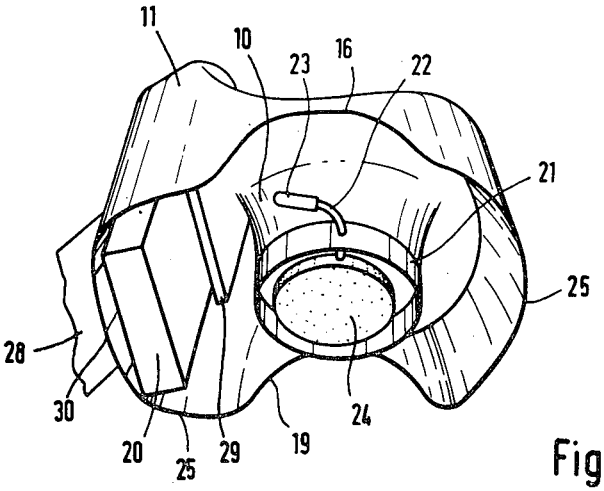
FIG. 3 is a view of another embodiment of a commode according to the present invention showing the fastening of a tissue package between the central supporting wall and the outer supporting wall.

In the embodiment shown in FIG. 3, the pocket for the objects may take the form of a cavity between the center wall 10 and the rear wall 30 of the enlarged backrest 11 of the outer wall 25. The pocket is open at both its top and bottom and has side walls 29 which form resilient clamping members standing away from the rear surface of the backrest 11. A socket is formed by the clamping means in which a package may be held. In this embodiment the package may be provided with an opening designed for removing the tissues outwardly towards the rear. If so the opening 17 would be formed in the portion of back wall 30 facing to the rear, rather than the top. This opening in the back wall 30 portion may also form a grip so the device may be normally carried.

It will also be understood that the pocket 18 may be enlarged and formed to receive an axle pin on which a roll of toilet tissue is wound. The interior walls of the pocket are in such event, formed with bearings or holes for the axle pin or rod. There are several other ways in which to shape the pocket 18 for storing various objects. The opening may be shaped to receive a drawer, introduced therein, suitable stop or catch means being provided to hold the drawer in place. A pocket or receptacle may be affixed unto the commode by hooks, clamps, magnets, pressure sensitive tapes, or similar means.

Figure 4:
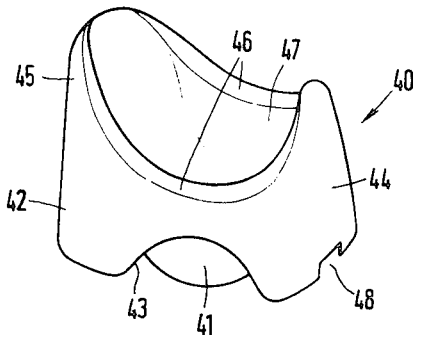
FIG. 4 is a view of a commode showing a recess in the supporting wall according to the invention.

The commode 40 according to FIG. 4 is similar in overall shape to that of FIG. 1 consisting of a pot-shaped center formed by wall 41 and having a circumferential downwards shaped outer supporting wall 42. The transition between the center part 41 and the positioning wall 42 is shaped as an anatomical sitting rim 46 which changes at its rearside into a back wall 45 and at its frontside into a deflector shield 44. The outer supporting wall 42 is provided on both sides with recesses 43 providing grip openings which open downwards. The center wall 41 forms a substantially round chamberpot and extends to the plane of the edge of the outer wall so as to also engage the ground or floor with the suction means.

The outer supporting wall 42 is provided on the lower edge of its front side with a recess 48, opening towards the bottom. The recess 48 is may be in the form of a slot for the mounting of a carrier bracket. This recess 48 does not impair the basic shape of the chamberpot and therefore, may be provided in all the embodiments if desired.

Figure 5:
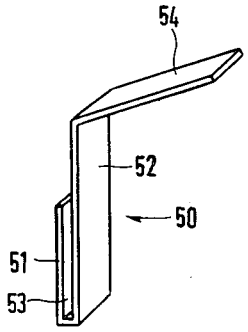
FIG. 5 is a perspective view of a carrier bracket having a shaped fastening end which may be fastened onto the recess shown in FIG. 4.
Figure 6:
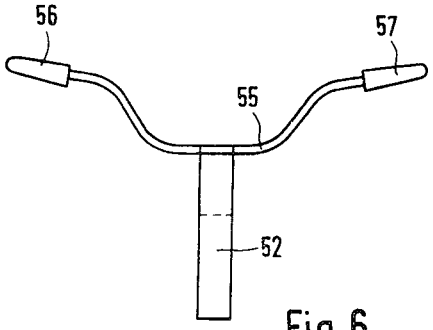
FIG. 6 shows a carrier with a fixedly secured steering lever.
Figure 7:
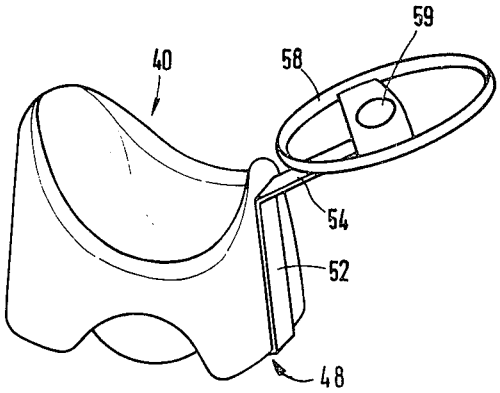
FIG. 7 shows a carrier with detachable steering wheel, as it is fastened unto the commode.

The carrying or holding elements for the commode are generally fastened unto the commode by a carrier bracket 50 which is seen in FIG. 5. The carrier bracket 50 is formed from springband material (either plastic or metal) into a U-shape having legs 51 and 52. The distance or space 53 between these legs conforms to the thickness of the outer wall and is introduced into the recess 48 so that the legs 51 and 52 resiliently embrace the outer wall 42, thereby securing the carrier bracket 50 without the need for any other fastening means. The recess 48 conforms in its parameters to the width and thickness of the material out of which the carrier 50 is formed. As shown in FIG. 7, this method insures that the introduction of the carrier 50 does not extend below the edge of the outer wall and does not hinder the positioning of the commode on the floor or other support. The front leg 52 is further bent outwardly into an end section 54 unto which may be detachably fastened a toy or plaything such as a steering wheel 58 with a horn 59. Or, as seen in FIG. 6, a handle bar 55 having handles 56 and 57 may be fastened solidly unto the leg 52 of the carrier 50. Naturally, additional implements like a balloon horn, a bell, streamers or the like may be fastened unto the handle bar 55. Furthermore, any other additional implement may be fastened either fixedly or detachably to the carrier 50. Similar toys, handle bars or the like may be used in connection with the embodiment shown in FIGS. 1 and 2 wherein they will be insertable into the hole 13.

Various embodiments, modifications and changes have been described. Other such variations will be obvious to those skilled in this art. Accordingly, it is intended that the foregoing disclosure be taken as illustrative and not as limiting of the invention.

What is claimed:

1. A portable child's commode, comprising an inner peripherally extending wall having a depending portion defining a central pot;

an outer peripherally extending wall spaced from said inner wall in the lower regions thereof, said inner and outer walls being connected at their upper extremities to thereby form an anatomical seating ring, said inner and outer walls being formed so as to be cooperable to provide therebetween a pocket for releasable retention of selected toiletry articles;

said outer wall terminating in a lower edge, said lower edge and the bottom of said pot defining a base adapted to rest upon a support surface for the commode;

the said inner and outer walls being configured to provide a back rest to the rear of said central pot and an upwardly directed portion forwardly of said central pot to serve as a deflector.

2. The commode according to claim 1, wherein said inner and outer walls comprise a unitary plastic injection molded part and said pocket is formed integrally therewith.

3. The commode according to claim 1, wherein said outer wall is formed with an opening extending to the rear of said backrest for the withdrawal of said toiletry articles.

4. The commode according to claim 1 including slots provided in said backrest adapted to receive a safety strap inserted within said slots.

5. The commode according to claim 1, wherein said deflector is provided with at least one fastening hole for the mounting of a handle.

6. The commode according to claim 5, wherein said handle is in the form of a bar, toy, animal or the like.

7. The commode according to claim 1, wherein recesses are formed along the sides of the outer wall to form hand grips.

8. The commode according to claim 1 including suction means are mounted to the underside of the central pot to selectively secure said body to a fixed support or floor.

9. The commode according to claim 1, wherein said outer wall is formed with a recess along its bottom edge, and includes a U-shaped bracket having two spaced legs adapted to resiliently enter said recess and embracing said outer wall, said bracket being adapted to receive a carrier for said body.

10. The commode according to claim 9, wherein the recess has a width corresponding to the width of the bracket, said bracket being made by bending a flat member, and that the height of the recess matches approximately the thickness of the outer wall.

11. The commode according to claim 9, characterized in that the distance between the two legs of the bracket matches approximately the thickness of the outer wall.

12. The commode according to claim 9, wherein one leg of the bracket matches in its length approximately the height of the positioning wall within the area of the recess.

13. The commode according to claim 9, wherein a handle member is fastened to the bracket.

14. The commode according to claim 8, wherein one portion of the pocket is defined by a depending resilient side wall which serves as a clamping member for retention of the toiletry articles.

15. The commode according to claim 1, wherein said suction means is mounted on the lower portion of said central pot in spaced relation therewith.

16. The commode according to claim 15, including an adjusting lever pivotably mounted on said central pot and carrying said suction means.

17. The commode according to claim 16, including a rim member depending from said central pot, said lever being mounted on said rim member and said suction means being a deformable plate element dimensioned and configured to be recessed within said rim member when shifted by the lever into an upper storage position.

* * * * *